US005724872A

United States Patent [19]

Shih

[11] Patent Number: 5,724,872

[45] Date of Patent: Mar. 10, 1998

[54] SOCKET SPANNER HAVING A NUT RETAINING DEVICE

[76] Inventor: Leo Shih, No. 5, Lane 54, San Min Rd, Sec 3, Taichung, Taiwan

[21] Appl. No.: 672,859

[22] Filed: Jun. 28, 1996

[51] Int. Cl.[6] ..... B25B 13/02

[52] U.S. Cl. ..... 81/125; 81/452

[58] Field of Search ..... 81/125, 180.1, 81/13, 177.85, 438, 451, 452

[56] References Cited

U.S. PATENT DOCUMENTS

| | | | |
|---|---|---|---|
| 271,549 | 1/1883 | True | 81/125 |
| 2,304,271 | 12/1942 | Merriman et al. | 81/125 |
| 2,549,397 | 4/1951 | Sparks | 81/177.85 |
| 3,665,791 | 5/1972 | Carr | 81/125 |
| 3,835,737 | 9/1974 | Carr | 81/125 |
| 4,787,278 | 11/1988 | Bononi | 81/125 |

*Primary Examiner*—D.S. Meislin
*Assistant Examiner*—Joni B. Danganan
*Attorney, Agent, or Firm*—W. Wayne Lianh

[57] ABSTRACT

A socket spanner having U-shaped elastic body and a fitting end configured to receive a nut. The fitting hole of the fitting end contains a pair of grooves respectively provided on two opposite inner walls thereof for engaging the U-shaped elastic body. The fitting hole further contains a circular slot located in an outer end of an inner wall of the fitting hole. The U-shaped elastic body includes an arcuate head portion and two arms, the two arms are received by the pair of grooves, respectively, of the fitting hole and at least one of the two arms is provided with a protruded portion capable of retaining a nut held in the fitting hole. At least one of the two arms is provided at a free end thereof with a curved or hooked portion engageable with the circular slot, so as to retain the U-shaped elastic body in the fitting hole.

9 Claims, 8 Drawing Sheets

SOCKET SPANNER HAVING A NUT RETAINING DEVICE

FIELD OF THE INVENTION

The present invention relates generally to a socket spanner, and more particularly to a socket spanner provided with a nut retaining device.

BACKGROUND OF THE INVENTION

There are various types of spanners, such as open-ended spanner, ring spanner, socket spanner, etc. The socket spanner is a very handy tool by virtue of the fact that it is provided with the sockets of various sizes. As shown in FIG. 1, a prior art socket spanner is composed of a socket 1 which has a pivoting end 1 drive end 2 for fastening with a handle 5 and further has a fitting end 3 having a hexagonal hole for engaging a nut 4. Such a conventional socket spanner as described above is defective in design in that the nut 4, which is located in the hexagonal hole of the fitting end 3, is prone to fall out of the hexagonal hole of the fitting end 3, especially at such time when the socket spanner is held in such a manner that open end of the fitting end 3 faces downwards. An improved socket spanner was therefore introduced. As shown in FIG. 2, the improved socket spanner has a fitting end 6 with a hexagonal hole which is provided with unequal sides. An elastic piece 8 of a U-shaped construction is inserted into the hexagonal hole of the fitting end 6 such that the elastic piece 8 is held by the inner walls 7 of two short sides opposite in location to each other, and that the head portion 9 of the elastic piece 8 is attached intimately with the bottom inner wall of the hexagonal hole of the fitting end 6. Such an improved socket spanner as described above has inherent shortcomings, which are explicitly described hereinafter.

The short sides 7 of the inner wall of the hexagonal hole of the improved socket spanner of the prior art are relatively thinner and are therefore weaker in the structural strength, as shown in FIG. 3. In addition, the junctions A between the short sides 7 and the long sides are rather vulnerable to damage.

The nut held in the hexagonal hole of the improved socket spanner of the prior art can not be taken out easily without the U-shaped elastic piece 8 being forced out along with the nut. Moreover, the elasticity of the elastic piece 8 is caused to diminish gradually after a prolonged use of the improved socket spanner.

As illustrated in FIG. 4, the hexagonal hole of a prior art socket spanner is generally provided with a center hole 10, which is obstructed by the head portion 9 of the elastic piece 8. If a bolt 11 is longer than the depth of the hexagonal hole of the socket spanner, the head portion 9 of the elastic piece 8 prevents the bolt 11 from engaging the center hole 10.

SUMMARY OF THE INVENTION

The primary objective of the present invention is therefore to provide an innovative socket spanner capable of overcoming the deficiencies of the prior art socket spanners described above.

The socket spanner of the present invention is provided in the hexagonal hole of the fitting end of the socket thereof with an elastic body capable of preventing a nut held in the hexagonal hole from slipping out. The elastic body can not be forced out of the hexagonal hole along with the nut held in the hexagonal hole. The elastic body has an arcuate head portion which does not obstruct the center hole of the hexagonal hole of the socket.

The foregoing objective, features, functions and advantages of the present invention will be more readily understood upon a thoughtful deliberation of the following detailed description of the embodiments of the present invention in conjunction with the accompanying drawings.

DETAILED DESCRIPTION OF THE EMBODIMENTS

Figure 1:
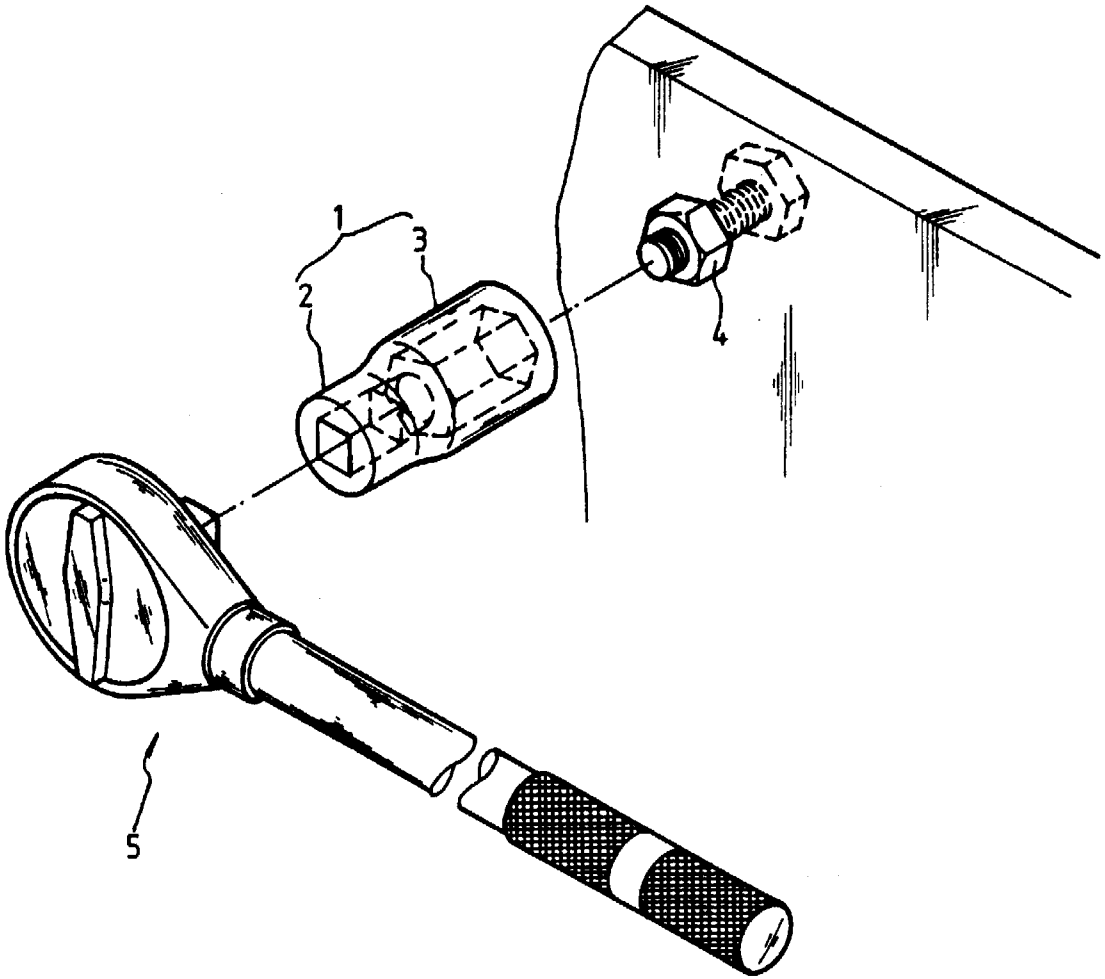
Fig. 1 PRIOR ART
FIG. 1 shows a schematic view of a prior art socket spanner.
Figure 3:
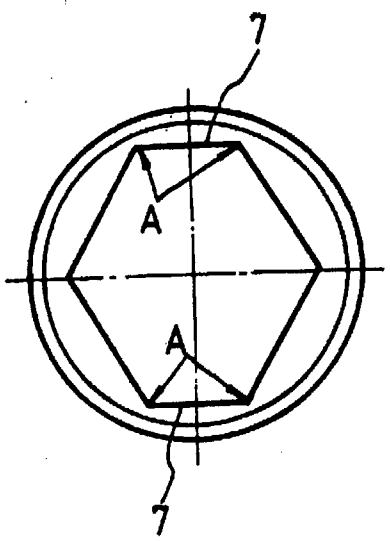
Fig. 3 PRIOR ART
FIG. 3 shows a schematic view of a socket of the prior art socket spanner as shown in FIG. 2.
Figure 2:
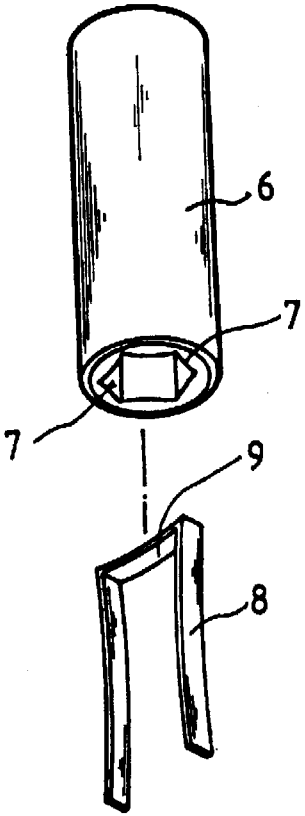
Fig. 2 PRIOR ART
FIG. 2 shows a schematic view of another prior art socket spanner.
Figure 4:
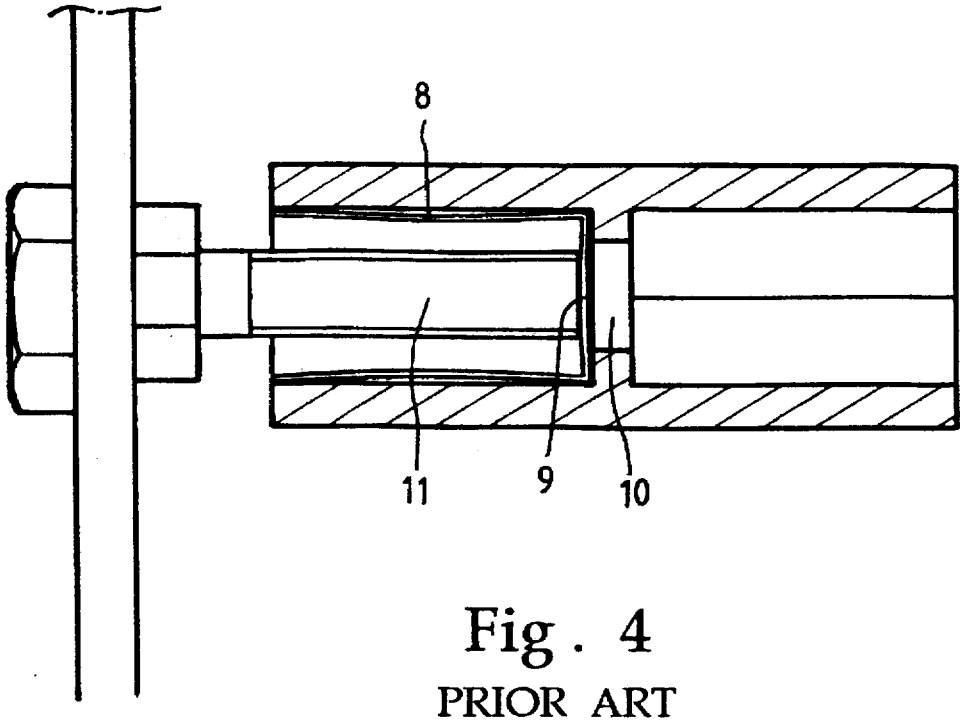
Fig. 4 PRIOR ART
FIG. 4 shows another schematic view of the socket of the prior art socket spanner as shown in FIG. 2.
Figure 5:
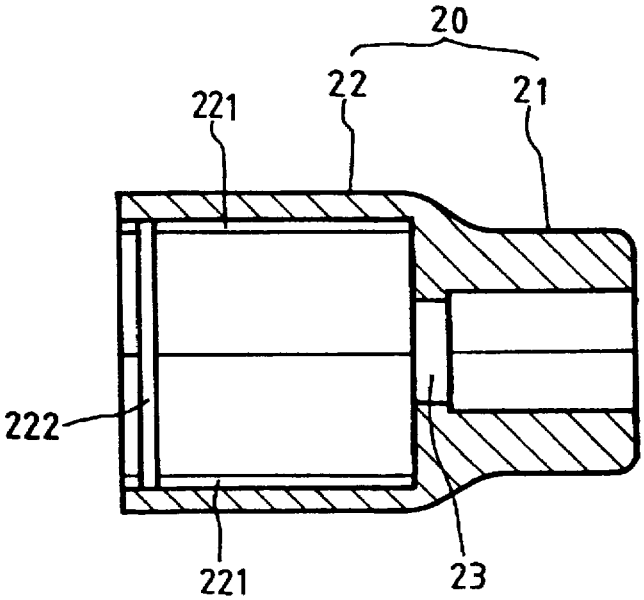
FIG. 5 shows a sectional schematic view of the socket of the socket spanner of the present invention.
Figure 6:
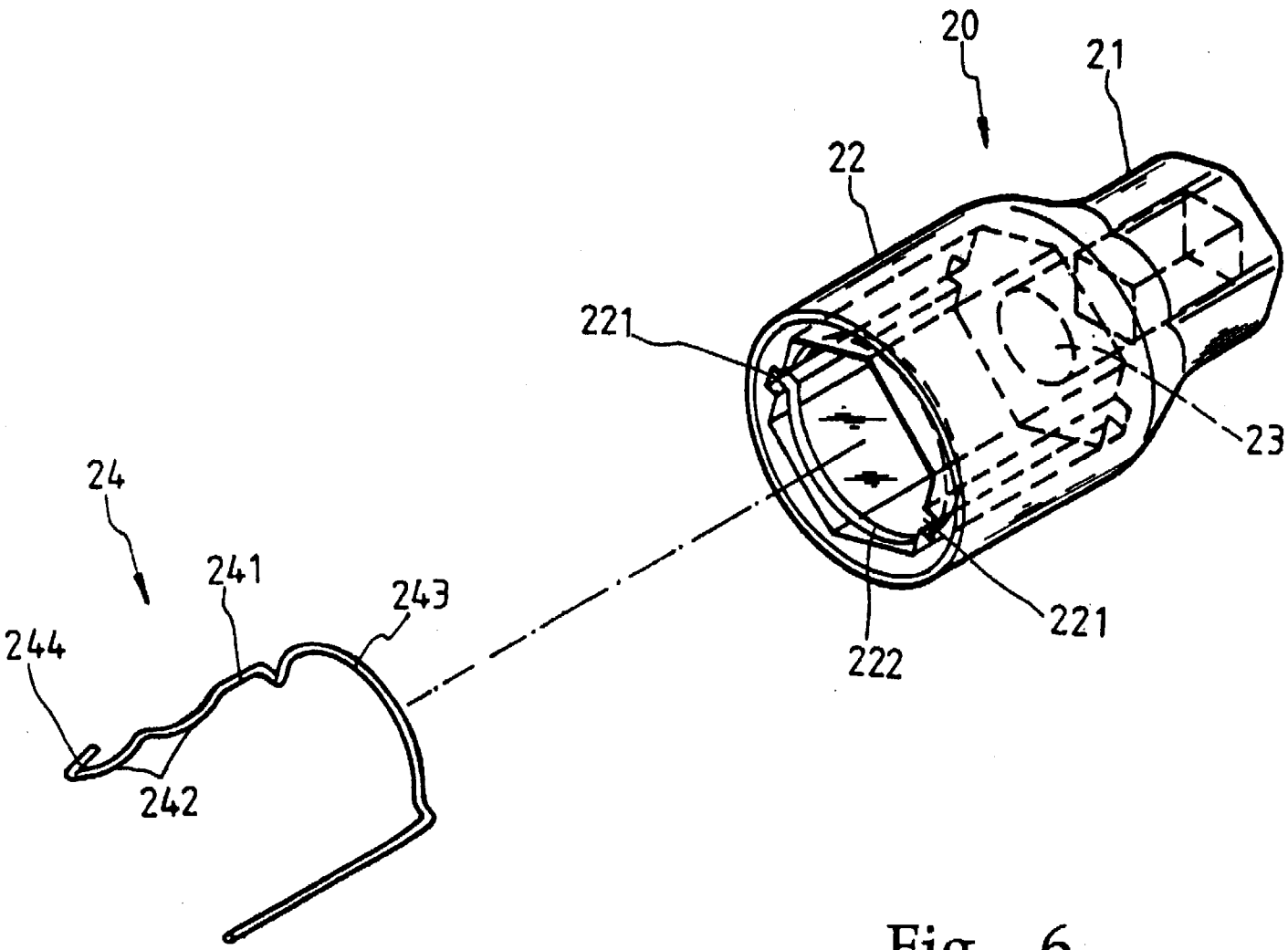
FIG. 6 shows an exploded view of the socket spanner of the present invention.

As shown in FIGS. 5–8, a socket 20 of the socket spanner of the present invention has a pivoting end 1 drive end 21 for fastening with a handle, and a fitting end 22 having a hexagonal hole. Located between the pivoting end 21 and the fitting end 22 is an intermediate segment provided therein with a center hole 23. The hexagonal hole of the fitting end 22 has two opposite inner walls which are provided respectively with a groove 221. Located near the outer end of the hexagonal hole is a circular slot 222. An elastic body 24 is forced into the socket 20 such that a retaining arm 241 of the elastic body 24 is moved along the groove 221, and that the end portion 244 of the elastic body 24 is located in the circular slot, and further that a head portion 243 of an arcuate construction is prevented from obstructing the center hole 23 of the socket 20.

Figure 8:
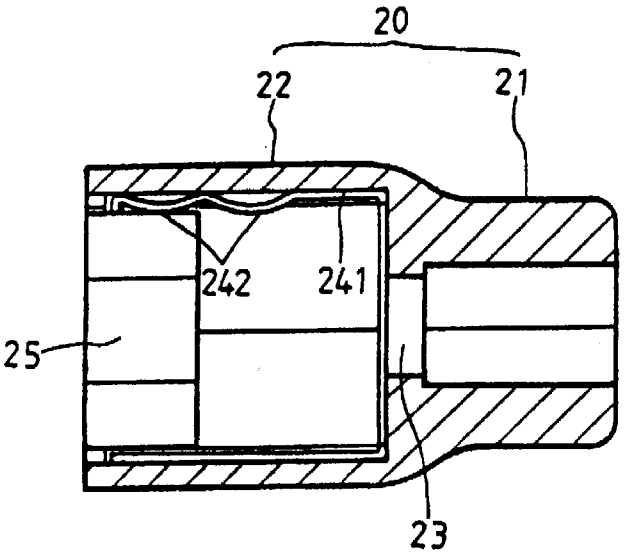
FIG. 8 shows a schematic view of a socket spanner at work according to a first preferred embodiment of the present invention, showing a nut is received by the fitting hole of the present invention and is gripped by the elastic body provided therein.
Figure 7:
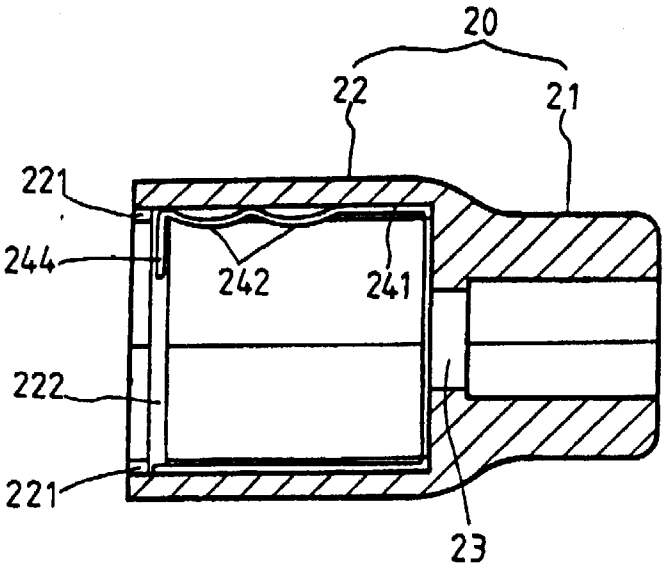
FIG. 7 shows a sectional schematic view of the combination of the socket of the socket spanner of the present invention.
Figure 9:
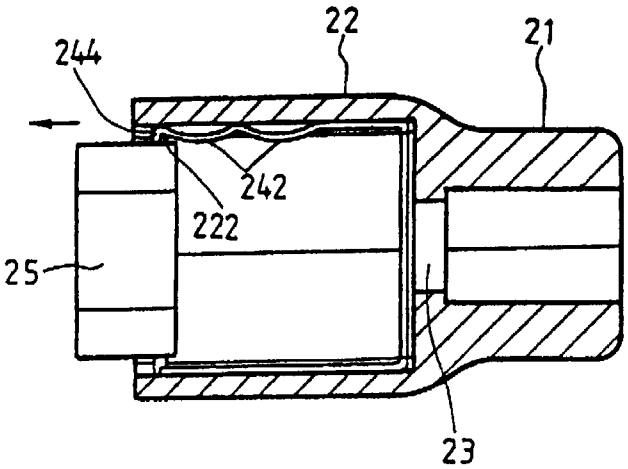
FIG. 9 shows a schematic view of a socket spanner at work according to the first preferred embodiment of the present invention, showing the nut is being released from the fitting hole while the elastic body is retained in the fitting hole by the circular slot provided therein.

In operation, a nut 25 is held in the fitting end 22 of the socket 20 such that the nut 25 is retained securely by two protruded portions 242 of the retaining arm 241 of the elastic body 24, as shown in FIG. 8. On the other hand, when an external force is applied so as to force out the nut 25 from the fitting end 22, the elastic body 24 is prevented from being forced out of the fitting end 22 of the socket 20 along with the nut 25, because of the end portion 244 of the elastic body 24, which urges the wall of the circular slot 222, as shown in FIG. 9.

Figure 10:
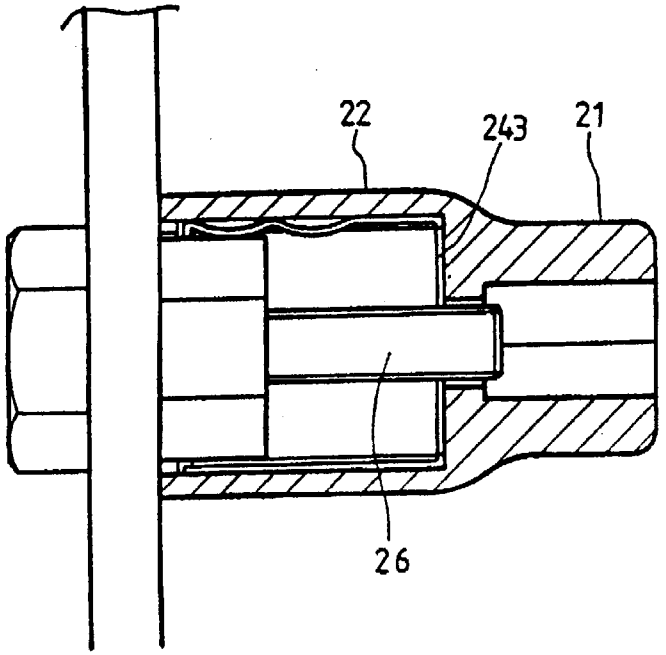
FIG. 10 shows a plan schematic view of a socket spanner of the first preferred embodiment of the present invention, wherein a nut with a long bolt is received by the fitting hole.

As shown in FIG. 10, a long bolt 26 is capable of engaging the center hole 23, because the elastic body 24 is provided with an arcuate head portion 243 which does not obstruct the center hole 23.

Figure 11:
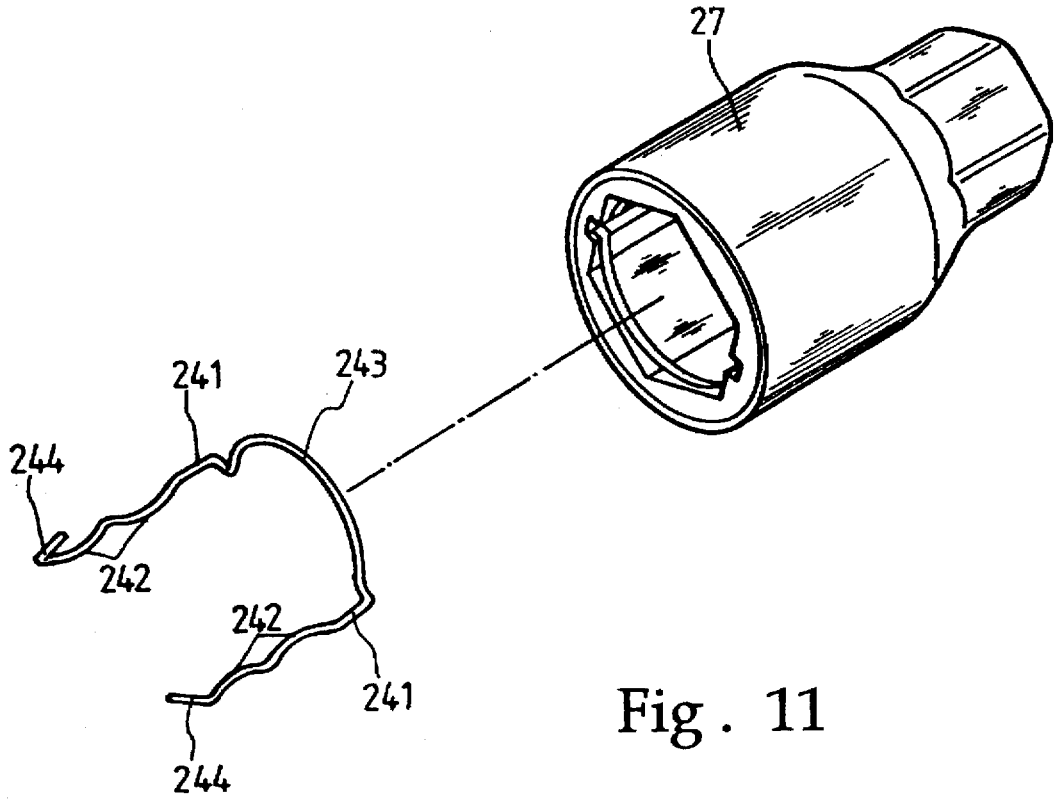
FIG. 11 shows a schematic view of another form of the present invention.
Figure 12:
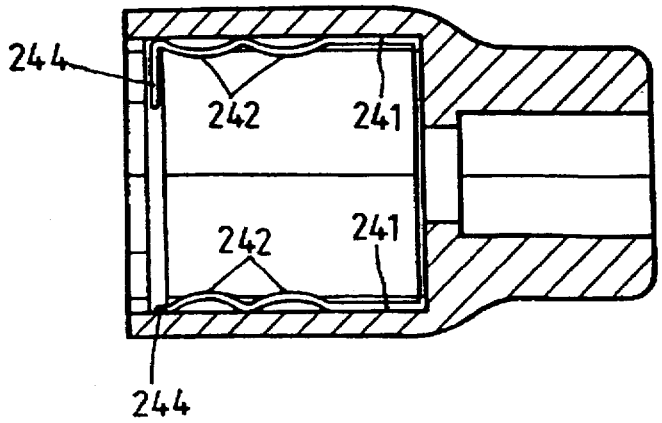
FIG. 12 shows a sectional schematic view of another form as shown in FIG. 11.

As shown in FIGS. 11 and 12, the protruded portions 242 are not confined to one retaining arm 241. In other words, both retaining arms 241 of the elastic linear body 24 may be provided with the protruded portions 242. In addition, both end portions 244 of the elastic linear body 24 may be curved or hooked.

Figure 13:
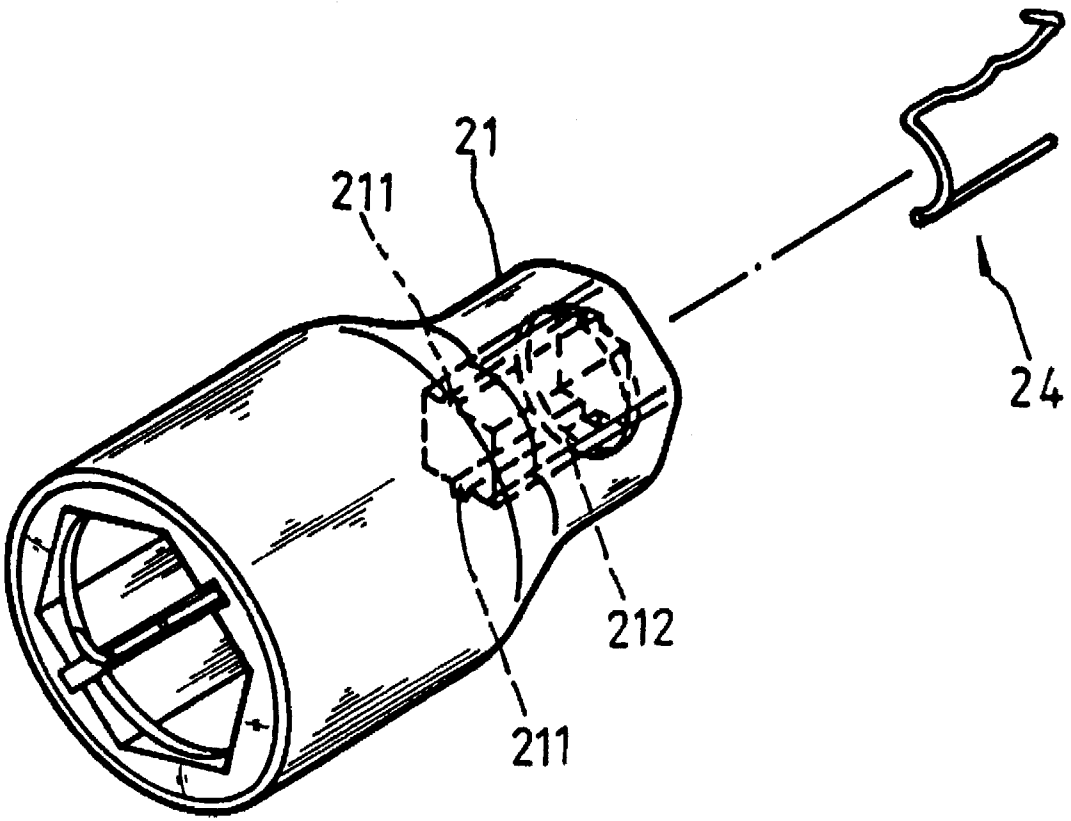
FIG. 13 shows an exploded view of a fourth preferred embodiment of the present invention.

As shown in FIG. 13, the elastic body 24 may be used in the pivoting end 21 which is provided with a pivoting hole of a square cross section. The square pivoting hole has two opposite inner walls provided respectively with a groove 211. Located near the outer edge of the square pivoting hole is a circular slot 212. The elastic body 24 serves to retain securely a handle engaging the pivoting hole of the pivoting end 21.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A socket spanner comprising a socket and a U-shaped elastic body, said socket having a fitting end, a drive end and an intermediate section located between said fitting end and said drive end and provided therein with a center hole in communication with a fitting hole of said fitting end, said pivoting end being configured to receive a handle, and said fitting hole being configured to receive a nut;

wherein said fitting hole of said fitting end contains a pair of grooves respectively provided on two opposite inner walls of said fitting hole for engaging said U-shaped elastic body, said fitting hole further contains a circular slot located in an outer end of an inner wall of said fitting hole also for engaging said U-shaped elastic body;

further wherein said U-shaped elastic body comprises an arcuate head portion and two arms extending therefrom, said arcuate head portion lying in a plane, said two arms are received by said pair of grooves, respectively, of said fitting hole and at lease one of said two arms is provided with two protruded portions capable of retaining a nut held in said fitting hole, and said at least one of said two arms is provided at a free end thereof with a curved portion lying in a plane parallel with said plane of said arcuate head portion and lying wholly within said circular slot.

2. The socket spanner as defined in claim 1, wherein said two arms of said elastic body are provided respectively with a protruded portion capable of retaining a nut held in said fitting hole.

3. The socket spanner as defined in claim 1, wherein said two arms of said elastic body are provided respectively with said curved portion for preventing said elastic body from becoming disengaged with said fitting hole of said socket.

4. The socket spanner as defined in claim 1, wherein said fitting hole of said socket has a polygonal cross section.

5. The socket spanner as defined in claim 1, wherein said two arms of said elastic body are provided with one or more of said protruded portions.

6. The socket spanner as defined in claim 1, wherein said drive end of said socket has a drive hole square in its cross section, said drive hole provided respectively in two opposite inner walls thereof with a groove engageable with one of said two arms of said elastic body capable of retaining securely a handle engaging said drive hole, said drive hole further provided with a circular slot located in an inner wall contiguous to an outer end of said drive hole.

7. The socket spanner as defined in claim 1, wherein said elastic body is secured to said fitting hole such that said arcuate head portion of said elastic body does not obstruct said center hole.

8. A socket spanner comprising a socket and a U-shaped elastic body, said socket having a fitting end which is configured to receive a nut;

wherein said fitting end contains a fitting hole which contains a pair of grooves respectively provided on two opposite inner walls of said fitting hole for engaging said U-shaped elastic body, said fitting hole further contains a circular slot located in an outer end of an inner wall of said fitting hole also for engaging said U-shaped elastic body; and said U-shaped elastic body comprises an arcuate head portion and two arms extending therefrom, said arcuate head portion lying in a plane, said two arms are received by said pair of grooves, respectively, of said fitting hole and at least one of said two arms is provided with two protruded portions capable of retaining a nut held in said fitting hole, and said at least one of said two arms is provided at a free end thereof with a curved portion lying in a plane parallel with said plane of said arcuate head portion and lying wholly within said circular slot.

9. A socket spanner according to claim 8 wherein said fitting hole has a polygonal cross-section.

* * * * *